US012486625B2

(12) United States Patent
Buschmann et al.

(10) Patent No.: US 12,486,625 B2
(45) Date of Patent: Dec. 2, 2025

(54) ROAD FINISHING MACHINE WITH SUCTION DEVICE

(71) Applicant: JOSEPH VOEGELE AG, Ludwigshafen/Rhein (DE)

(72) Inventors: Martin Buschmann, Neustadt (DE); Ralf Weiser, Ladenburg (DE); Roman Munz, Neustadt (DE)

(73) Assignee: Joseph Voegele AG, Ludwigshafen/Rhein (DE)

( * ) Notice: Subject to any disclaimer, the term of this patent is extended or adjusted under 35 U.S.C. 154(b) by 919 days.

(21) Appl. No.: 17/689,778

(22) Filed: Mar. 8, 2022

(65) Prior Publication Data

US 2022/0290381 A1 Sep. 15, 2022

(30) Foreign Application Priority Data

Mar. 9, 2021 (EP) ..... 21161432

(51) Int. Cl.
*E01C 19/42* (2006.01)
*E01C 19/00* (2006.01)
(Continued)

(52) U.S. Cl.
CPC ..... *E01C 19/42* (2013.01); *E01C 19/002* (2013.01); *E01C 19/176* (2013.01); *E01C 19/48* (2013.01); *E01C 2301/50* (2013.01)

(58) Field of Classification Search
CPC ..... E01C 19/002; E01C 19/176; E01C 19/42; E01C 19/48; E01C 2301/50
(Continued)

(56) References Cited

U.S. PATENT DOCUMENTS 4,012,160 A * 3/1977 Parker ..... E01C 19/4873 404/84.05
5,443,325 A 8/1995 Simonelli et al.
(Continued)

FOREIGN PATENT DOCUMENTS

AU 20003646600 A1 11/2000
CN 104812961 A 7/2015
(Continued)

OTHER PUBLICATIONS

European Search Report Dated Aug. 4, 2021, Application No. 21161432.6-1002, Applicant Joseph Voegele AG, 7 Pages.
(Continued)

*Primary Examiner* — Raymond W Addie
(74) *Attorney, Agent, or Firm* — Brooks Kushman P.C.

(57) ABSTRACT

A road finishing machine comprises a screed for producing a paving layer from a paving material, a material bunker for receiving the paving material, a longitudinal conveying device configured to transport the paving material from the material bunker toward the screed, and a transverse distributor auger configured to distribute the paving material transported by the longitudinal conveying device transversely in front of the screed. The transverse distributor auger is mounted in front of a screed basic body of the screed within a transverse distributor channel, which is formed at least in sections by channel plates supported at a chassis of the road finishing machine, and by pre-scrapers attached laterally of a screed basic body of the screed. The road finishing machine further includes at least one suction device with at least one intake line which is configured to suck off aerosols forming during the transverse distribution of the paving material.

20 Claims, 4 Drawing Sheets

(51) Int. Cl.
*E01C 19/17* (2006.01)
*E01C 19/48* (2006.01)

(58) Field of Classification Search
USPC ..... 404/75, 83–118
See application file for complete search history.

(56) References Cited

U.S. PATENT DOCUMENTS

| | | | | |
|---|---|---|---|---|
| 5,938,371 | A * | 8/1999 | Gustin | E01C 19/48 404/101 |
| 6,152,649 | A | 11/2000 | Snyder et al. | |
| 7,491,012 | B2 * | 2/2009 | Weiser | F01N 13/082 404/108 |
| 9,212,458 | B2 * | 12/2015 | Kappel | E01C 19/176 |
| 2004/0179895 | A1 * | 9/2004 | Lee | E01C 19/405 404/101 |
| 2014/0270952 | A1 * | 9/2014 | Karsten | E01C 23/088 404/75 |
| 2015/0152607 | A1 | 6/2015 | Kappel | |
| 2018/0030673 | A1 | 2/2018 | Martin | |
| 2019/0292735 | A1 * | 9/2019 | Coe | E01C 23/14 |
| 2022/0290381 | A1 | 9/2022 | Buschmann et al. | |

FOREIGN PATENT DOCUMENTS

| | | | |
|---|---|---|---|
| CN | 211713609 | U | 10/2020 |
| CN | 218345880 | U | 1/2023 |
| DE | 102012025589 | A1 | 9/2013 |
| DE | 10 2012 011 693 | A1 | 12/2013 |
| EP | 0 666 373 | A1 | 8/1995 |
| EP | 0 843 044 | A1 | 5/1998 |
| JP | 2012207493 | A | 10/2012 |
| JP | 2014012940 | A | 1/2014 |
| JP | 2014 139388 | A | 7/2014 |
| JP | 2017 095907 | A | 6/2017 |
| JP | 2017519920 | A | 7/2017 |
| JP | 2019007248 | A | 1/2019 |
| WO | 2020009123 | A1 | 1/2020 |

OTHER PUBLICATIONS

Chinese Search Report re CN App. No. 202210226776X, Applicant: Joseph Voegele AG, dated Oct. 21, 2024 (with English machine translation) (9 pages).
Chinese Office Action re CN App. No. 202210226776X, Applicant: Joseph Voegele AG, dated Oct. 23, 2024 (with English machine translation) (7 pages).
Chinese Search Report CN Application No. 202210226776X dated Oct. 21, 2024, English machine translation.
Chinese Office Action CN Application No. 202210226776X dated Oct. 23, 2024, English machine translation.
JP 2012207493 A, English machine translation.
DE 102012025589 A1, English machine translation.
CN 104812961 A, U.S. Pat. No. 9,212,458 B2.
CN 211713609 U, English machine translation.
CN 218345880 U, US 2022/0290381 A1, which is the publication of the present application.
Japanese Office Action, Application No. 2022-035935, Applicant Joseph Voegele AG, dated Jun. 20, 2025 (with English machine translation) (12 pages).

* cited by examiner

ROAD FINISHING MACHINE WITH SUCTION DEVICE

CROSS-REFERENCE TO RELATED APPLICATIONS

This application claims foreign priority benefits under 35 U.S.C. § 119(a)-(d) to European patent application number EP 21161432.6, filed Mar. 9, 2021, which is incorporated by reference in its entirety.

TECHNICAL FIELD

The present disclosure relates to a road finishing machine.

BACKGROUND

Road finishing machines are employed in practice for producing bitumen containing road pavements. During the laying of bituminously bound road construction material, bitumen containing aerosols are formed due to the high processing temperatures and influence the air quality in the surrounding area of the road finishing machine. At known road finishing machines, suction systems for sucking off the aerosols are therefore used to prevent an aerosol concentration in the air from reaching a critical value.

In known suction systems, the aerosols are typically sucked off near the machine's center, i.e., centrally at the outlet of a scraper belt which transports the paving material from the material bunker of the road finishing machine to its screed. At the outlet of the scraper belt, the paving material is discharged from the scraper belt's end into a transverse distributor region and distributed in front of the screed of the road finishing machine by means of a transverse distributor auger arranged therein. During the transverse distribution of the paving material to the respective outer sides of the screed, aerosols are, however, still formed after the paving material has laterally left the region underneath the scraper belt. The aerosols formed along the outer sections of the screed, however, are no longer sufficiently collected by conventional centrally arranged suction systems.

EP 0 843 044 A1 discloses a road finishing machine with a ventilation system for sucking off aerosols, in particular rising vapors, from a region above the transverse distributor system. The suction device employed for this in particular consists of a suction device part which covers the auger space at least to the top and optionally extends laterally to extendable pull-out parts provided at the screed. The problem with this suction device is that the view of the screed operator into the region of the transverse material distribution is highly restricted. Moreover, the assembly of this suction device is cumbersome, above all if pull-out parts and/or lateral screed attachments for broadening the paving width are employed at the screed.

SUMMARY

It is an object of the disclosure to provide a road finishing machine with a suction device whereby the drawbacks described above in connection with prior art can be reduced.

The present disclosure relates to a road finishing machine comprising a screed for producing a paving layer from a paving material, in particular for producing a paving layer from a bituminously bound paving material. The road finishing machine according to the disclosure furthermore includes a material bunker for receiving the paving material, and a longitudinal conveying device which is configured to transport the paving material from the material bunker, against a direction of travel of the road finishing machine, to the screed.

The road finishing machine according to the disclosure furthermore comprises at least one transverse distributor auger which is configured to distribute the paving material transported to the screed by means of the longitudinal conveying device in front of the screed transversely to the direction of travel. The transverse distributor auger is mounted in front of a screed basic body of the screed in the direction of travel, preferably also within a transverse distributor channel optionally arranged in front of the screed for the transverse distribution of the paving material, which is formed, at least in sections, by means of channel plates supported at a chassis of the road finishing machine and by means of pre-scrapers attached laterally of the screed basic body of the screed transversely to the direction of travel in front of the screed.

Moreover, the road finishing machine according to the disclosure includes at least one suction device with at least one intake line formed thereat at the inlet side which is configured to suck off aerosols formed during the transverse distribution of the paving material, in particular from regions along the transverse distributor channel. Above all, aerosols can thereby be sucked off from outer regions of the transverse distributor channel.

According to the disclosure, the intake line is arranged, at least in sections, at the channel plates of the transverse distributor channel, at least in sections at the pre-scrapers of the transverse distributor channel, at least in sections at a front side of the screed basic body facing the transverse distributor auger, and/or at least in sections at an external control platform of the screed.

In other words, in the disclosure, the screed basic body, the channel plates, the pre-scrapers, and/or the external control platform of the screed are employed as a basis for attaching the intake line. The intake line according to the disclosure is thus arranged directly at a screed part of the screed which is anyway provided, and/or at a component of the transverse distributor channel optionally arranged in front of it.

Thereby, several advantages relevant for practice result from the road finishing machine according to the disclosure, in particular due to the suction system employed thereat according to the disclosure. On the one hand, the suction device can thereby be mounted without major efforts since its intake line is directly attached to structures of the screed. The disclosure furthermore offers the possibility of installing the suction device compactly at the road finishing machine. The suction device can moreover altogether be manufactured at lower costs compared to conventional solutions due to their reduced design. The suction device can also be flexibly adapted to a desired working width. By the suction line being arranged directly at the external control platform, in particular at a component employed for its assembly, e.g., at a side pusher, at the screed basic body, at the channel plates, and/or at the pre-scrapers, it extends directly approximate to the paving material conveyed transversely in front of the screed, so that the suction of aerosols along the intake line can be performed particularly effectively.

Preferably, the intake line is arranged, at least in sections, at a side of the channel plates of the transverse distributor channel facing the transverse distributor auger, and/or at least in sections at a side of the pre-scraper of the transverse distributor channel facing the transverse distributor auger.

It would be conceivable for the road finishing machine to include a first suction device which comprises the intake line for the channel plates, the pre-scrapers, and/or the front side of the screed basic body, and/or a second suction device which comprises the intake line of the external control platform. The two suction devices can preferably be controlled independently.

Preferably, the intake line is a pipeline extending transversely to the direction of travel. It would be conceivable that the pipeline has a round pipeline cross-section, while other cross-sectional geometries are also conceivable. The intake line is, in the form of a pipeline, compactly formed at the channel plate, at the pre-scraper, at the screed basic body, and/or at the external control platform, so that the transverse distribution of the paving material remains easily visible by a screed operator across the total set paving width, no matter on which side of the screed he/she is located. The pipeline can have an inside pipe diameter of only a few centimeters, for example, approximately 5 to 10 cm.

According to an embodiment of the disclosure, the intake line is formed in the form of a rectangular pipe at least in sections. With this component geometry, the intake line can be fixed to the channel plate, the pre-scraper, the screed basic body, and/or the external control site in a particularly stable manner. In addition, the intake line in the form of a rectangular pipe also provides a very robust construction for the other geometries that support it, above all the constructions of the transverse distributor channel employed for it as a basis.

Independent of the shape of the intake line as such, the intake line can be arranged in the direction of travel either in the foreground or in the background with respect to the side of the component supporting the same. This means that the intake line is formed either as a structurally visible line section externally along the channel plates, the pre-scrapers, the screed basic body, and/or at the external control platform, in particular along a side pusher support of the side pusher, or is formed to be integrated therein, whereby the observer only sees intake openings at these structures. In the latter design, the intake line would thus extend invisibly within the construction of the channel plates, the pre-scrapers, the screed basic body, and/or the side pusher support. Thereby, the intake line is mounted in a perfectly protected manner and allows the screed operator an unrestricted view on the transverse material distribution.

Preferably, the intake line is made of a corrosion-resistant metal. In particular, the intake line is made of a light metal, for example of aluminum, to facilitate the broadening of the screed. It is conceivable that the intake line is made of the material of the support component employed for it, that means of the material of the channel plates, the pre-scrapers, and/or the front side of the screed basic body, so that the intake line is formed to be optically unobtrusive.

The intake line is in particular formed in the form of an intake rail. The latter can be integrated at the screed structure and attachments formed thereon in a particularly compact manner. It is conceivable that the intake rail extends along the complete width of the arranged transverse distributor channel. Thereby, aerosols can be perfectly sucked off across the complete width of the transverse distributor channel, in particular to the outer sides of the screed.

A particularly compact design can result from the intake line including a wall which is formed, at least in sections, as an integral part of the channel plates, the pre-scrapers, the front side of the screed basic body, and/or a component of the external control platform, e.g., the side pusher support. The intake line can, according to this variant, be formed at the respective support side of the channel plates, the pre-scrapers, the component of the external control platform, and/or screed basic body, be it in the foreground or the background in the direction of travel in a shape-integrated manner. Thereby, the compact design of the intake line can be improved even further. At the external control platform, the intake line could be formed as part of the side pusher support, in particular integrated therein.

Preferably, the intake line is formed, at least in sections, along an upper edge of the channel plates, along an upper edge of the pre-scrapers, and/or along an upper edge of a side pusher support of the external control platform. Thereby, the intake line extends directly along an upper border of the transverse distributor channel, so that aerosols or vapors formed therein can be better sucked off directly at the place where they occur. In addition, an arrangement at the respective upper edge of the channel plates and/or the pre-scrapers can be a useful orientation aid for the assembly of the transverse distributor channel. The intake line can also be formed along the upper edge of the support component, in the direction of travel either on the front side, that means as an attachment formed thereat, or integrated to it, that means in the internal structure of the support component.

In particular, the intake line formed at the front side of the screed basic body, at the external control platform, at the channel plates, and/or at the pre-scrapers is dimensioned such that the transverse distributor channel remains essentially uncovered, seen from the top. This means that the intake line has essentially smaller dimensions in the direction of travel than the transverse distributor channel, so that an operator can perfectly observe the flow of material conveyed sidewards within the transverse distributor channel during a paving operation of the road finishing machine.

Preferably, the intake line forms, along the transverse distributor channel, an exhaust air guide for the sucked off aerosols arranged transversely to the direction of travel. The exhaust air guide can extend to outer sides of the screed and/or to the center of the screed. Along the exhaust air guide, the intake line can have a plurality of intake openings, so that the exhaust air flow conveyed within the exhaust air guide is formed of a plurality of intake flows.

It is advantageous for the intake line to include a plurality of interconnectable line sections preferably arranged in series transversely to the direction of travel whose coupling ends are formed in the region of separating points of adjacently attached channel plates and/or adjacently attached pre-scrapers. Preferably, the channel plates and/or the pre-scrapers, including the intake line formed thereat, can be assembled without tools, i.e., without any further aids. This facilitates their assembly on the construction site.

It would be conceivable for the suction device, at least, however, individual components of it, to be available as a retrofit kit to be arranged at the road finishing machine according to the disclosure.

It is possible that adjacent channel plates and/or pre-scrapers are built one against the other by means of the coupling ends of the intake line. For the assembly of the channel plates and/or the pre-scrapers, in this variant, the coupling ends of the intake line are present as fastening means whereby the assembly becomes even easier for the operator altogether. It is conceivable that the coupling ends of the intake line of adjacent channel plates and/or pre-scrapers are insertable into each other in sections, whereby an overlap between the coupling ends is formed.

According to a variant, the channel plates and/or the pre-scrapers are automatically movable transversely to the direction of travel in view of a set paving width. Intake lines attached thereat can in particular be formed to be telescopic so that the intake lines can automatically be adapted corresponding to an extension of the transverse distributor channel.

Preferably, the intake line includes a plurality of passages as intake openings. The intake openings can be formed, at least in sections, along the intake line to the outer sides of the screed. The passages can in particular have the form of a slot. Along the intake line, a plurality of parallel slots can be grouped at least in sections, or they can be formed continuously.

According to an embodiment, the intake line includes at least one closing mechanism for opening and closing at least one of the intake openings formed thereat. It is conceivable that by means of the closing mechanism, for a selective sucking-off of aerosols in the region of an external control platform of the screed, the intake openings adjacent thereto are set to be open, while other intake openings of the intake line which are located further to the center of the screed structure are selectively closed by means of the closing mechanism, so that a higher suction effect is formed in the region of the external control platform.

According to an variant of the disclosure, the intake openings are formed at different sides of the intake line. It is conceivable that intake openings are formed at the intake line along a side facing the transverse distributor auger in the direction of travel, along a side directed downwards to the subsoil, and/or along a side directed upwards.

It is advantageous for the suction device to include at least one fan connected to the intake line which is arranged, for example, in the region of an external control platform of the screed, in particular at a side pusher formed there for setting the paving width. Preferably, a fan power can be set directly at the external control platform by the screed operator, for example by means of a control device attached thereat. Corresponding to an aerosol development occurring during the paving operation, the screed operator can thus himself/herself adapt the fan power.

It would be conceivable that the suction device includes at least one fan arranged in the region of the chassis of the road finishing machine for sucking off the aerosols by means of the intake line formed at the front side of the screed basic body, and/or at least one further separate fan for sucking off the aerosols by means of the intake line formed at the channel plates, the pre-scrapers, and/or at the external control platform. In particular the latter part of the suction device could be offered to customers as a retrofit kit for large screed widths. Thereby, the fan power could also be well split across the complete working width, so that aerosols can be effectively sucked off by it. The fan mentioned in the second alternative can be directly installed at the external control platform.

Preferably, the suction device includes, on the outlet side, at least one exhaust air line which is fixed to a roof structure of the external control platform of the screed for ejecting the sucked-off aerosols. Thereby, the construction of the suction device can be essentially designed in the external area of the screed, so that an exhaust air guide erected over the chassis of the road finishing machine and over the roof structure of the driver control platform could optionally be eliminated.

According to one embodiment, the suction device comprises at least one activated-carbon filter unit. By this, the sucked-off air containing aerosols can be purified. Thereby, the quality of the working conditions for the operator of the road finishing machine can be further improved. The activated-carbon filter unit can be formed at the external control platform so that the air ejected thereat from the exhaust air line is not loaded with aerosols.

It is conceivable that the intake line of the channel plate, which is positioned closest to the chassis of the road finishing machine, is configured for a coupling with a vent line formed at the chassis of the road finishing machine. Thereby, the intake line can be connected with a suction system installed at the chassis of the road finishing machine.

Preferably, the suction device includes a spray device which is configured to spray a fluid, for example water vapor, above the transverse distributor channel into the aerosol formation formed therein to reduce a concentration of the aerosols. It is conceivable that the spray device includes at least one nozzle which is directly arranged at the intake line.

According to a variant of the disclosure, the suction device includes at least one sensor unit based on the measuring results of which a dynamic fan speed adaption can be carried out. The sensor unit can include a sensor which is configured to detect an aerosol content in its surrounding area which can be continuously held available as an ACTUAL value for a control loop for carrying out the dynamic fan speed adaption. A dynamic fan speed control can in particular respond to a detected temperature of the paving material.

BRIEF DESCRIPTION OF THE DRAWINGS

The disclosure will be illustrated more in detail with reference to exemplified embodiments according to the following figures. In the drawing.

Figure 1:
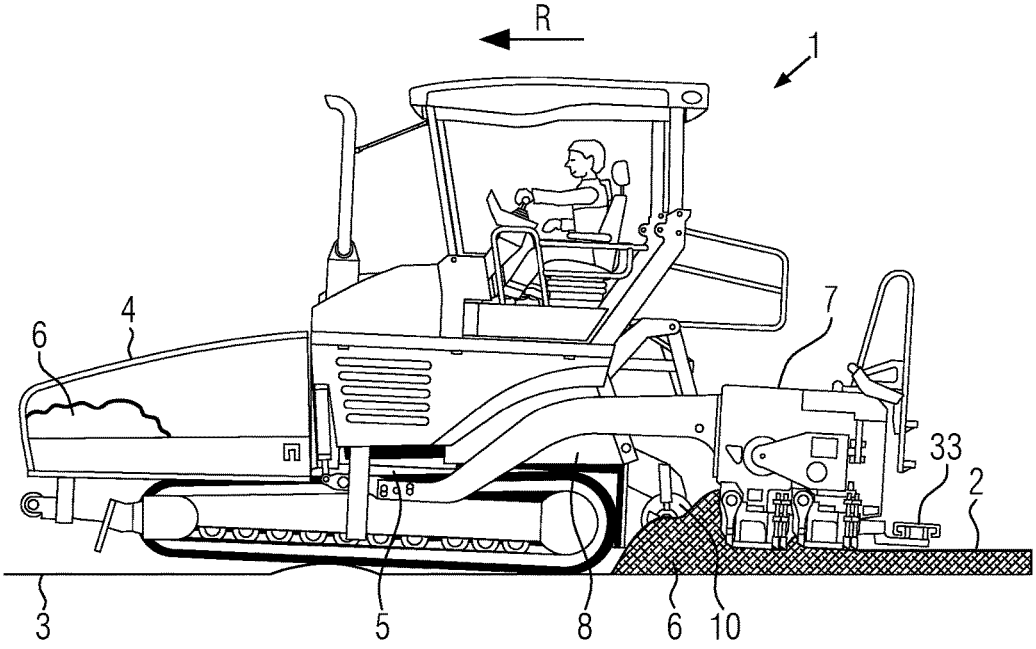
FIG. 1 shows a road finishing machine for producing a paving layer.

Equal components are always provided with equal reference numerals in the figures.

DETAILED DESCRIPTION

FIG. 1 shows a road finishing machine 1 for producing a paving layer 2 on a subsoil 3. The road finishing machine 1 includes, in the direction of travel R in the front, a material bunker 4 from which a paving material 6 received therein is transported, against the direction of travel R of the road finishing machine 1, to a screed 7 of the road finishing machine 1 by means of a longitudinal conveying device 5. The longitudinal conveying device 5 is arranged within a chassis 8 of the road finishing machine 1 and includes a scraper belt 9 that is shown in FIG. 3.

From the scraper belt 9 of the longitudinal conveying device 5, the paving material 6 is transferred to a transverse distributor auger 10 positioned in front of the screed 7. The transverse distributor auger 10 is configured to distribute the paving material 6 in front of the screed 7.

Figure 2:
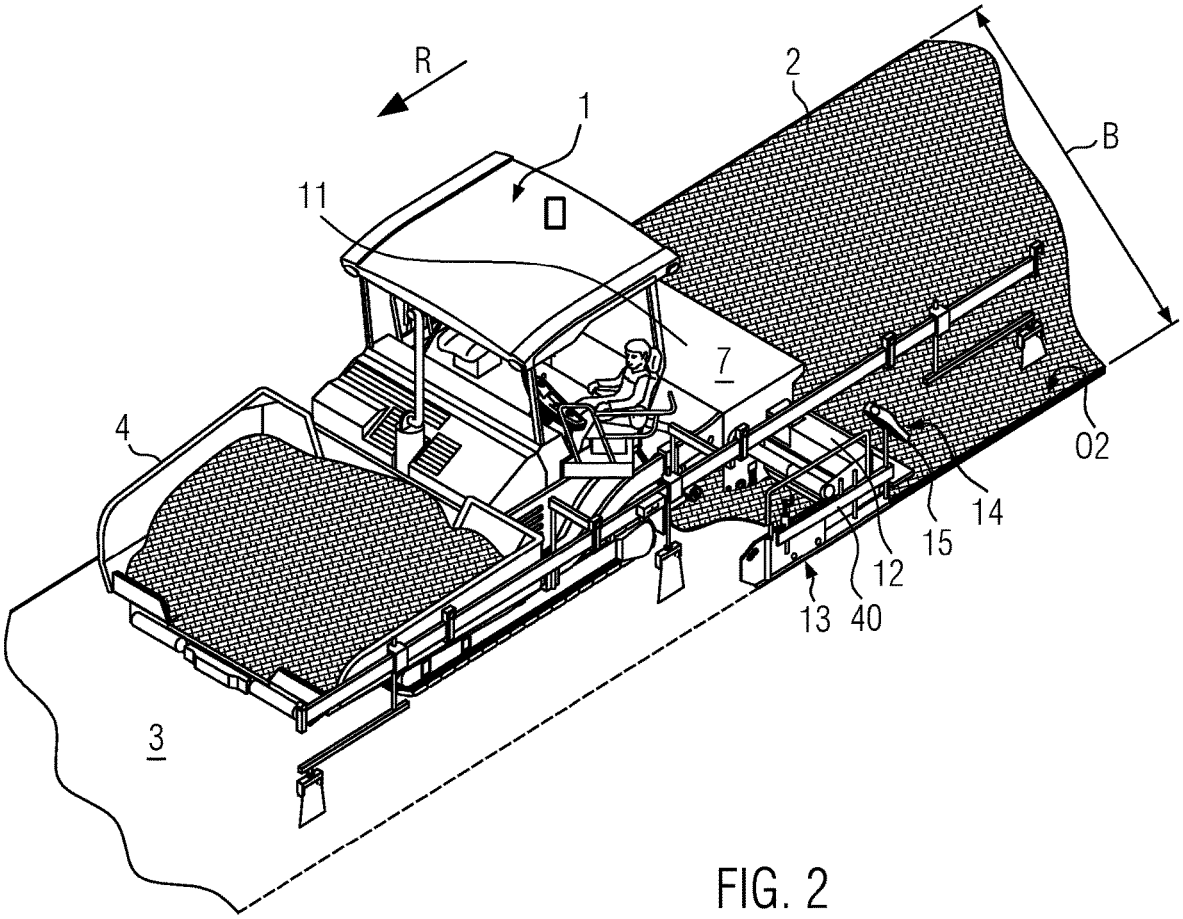
FIG. 2 shows a perspective representation of the road finishing machine with a screed which is provided as an extendable screed.

FIG. 2 shows the road finishing machine 1 in a perspective representation. The screed 7 includes a screed basic body 11 and pull-out parts 12 extendable to the side to set a desired working width B of the produced paving layer 2. The left pull-out part 12 shown in FIG. 2 has a side pusher 13 for setting the working width B of the newly installed paving layer 2. At the side pusher 13, an external control platform 14 is arranged which includes a control device 15 for a screed operator. The side pusher 13 includes a side pusher support 40 which can be employed for the construction of the external control platform 14. At the external control platform 14, the screed operator can control and/or monitor the operation of the screed 7. It is in particular convenient that the screed operator can monitor a transverse distribution of the paving material 6 in front of the screed 7, i.e., also in front of the pull-out parts 12.

Figure 3:
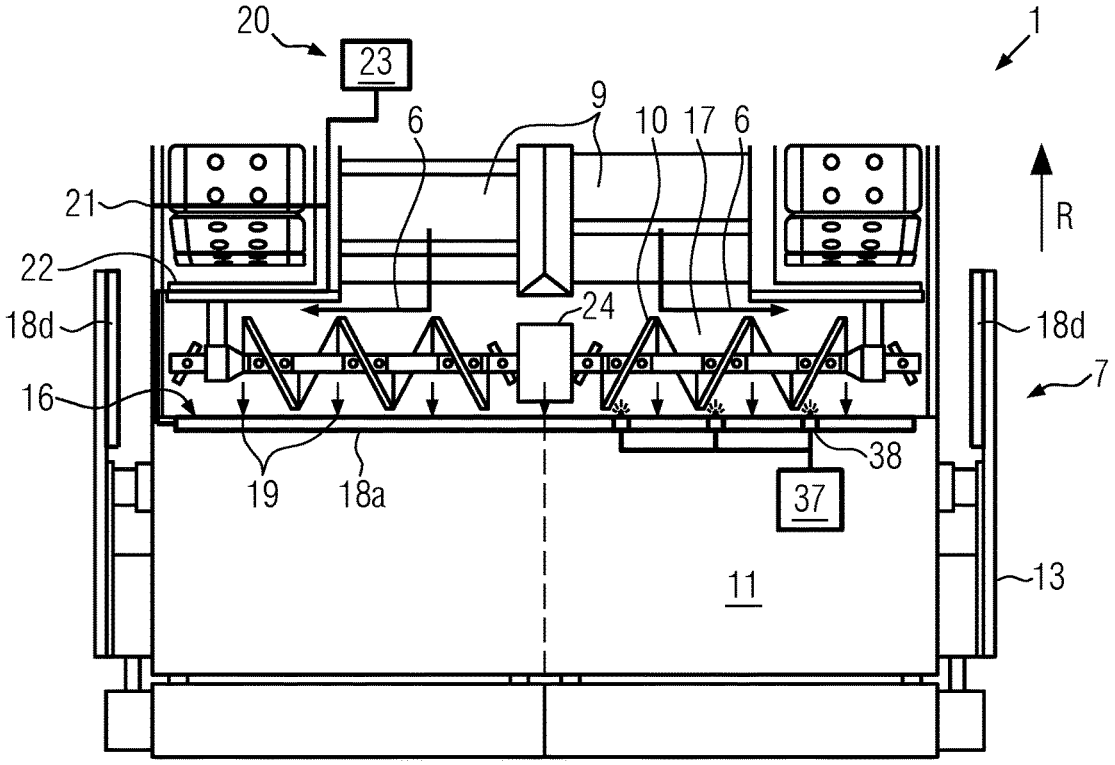
FIG. 3 shows a schematic plan view of an extendable screed for a road finishing machine.
Figure 4:
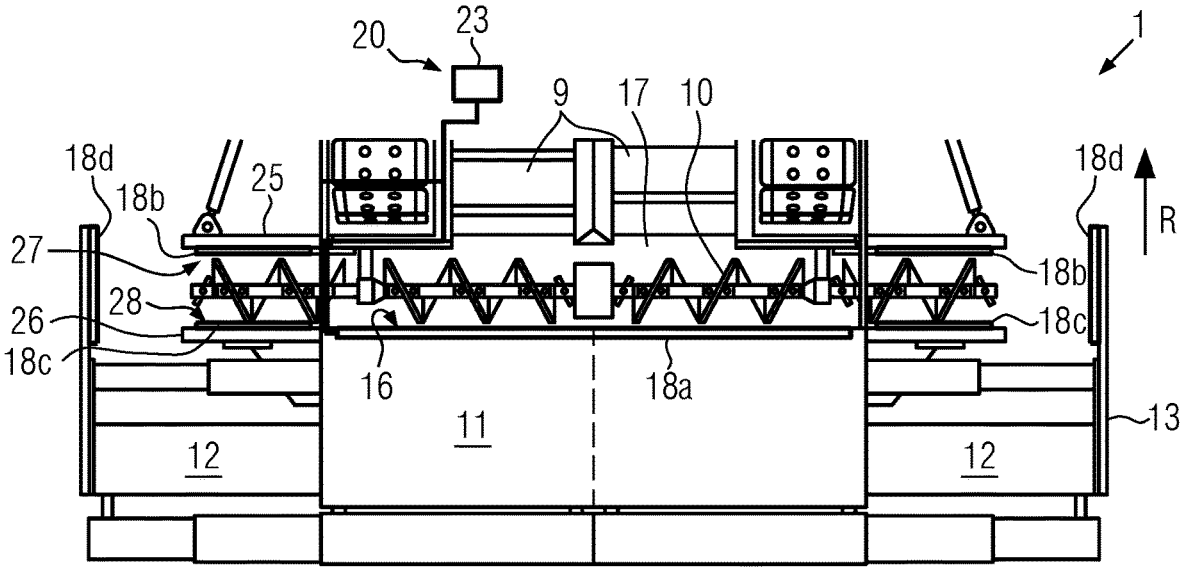
FIG. 4 shows the extendable screed of FIG. 3 with laterally extended pull-out parts.
Figure 5:
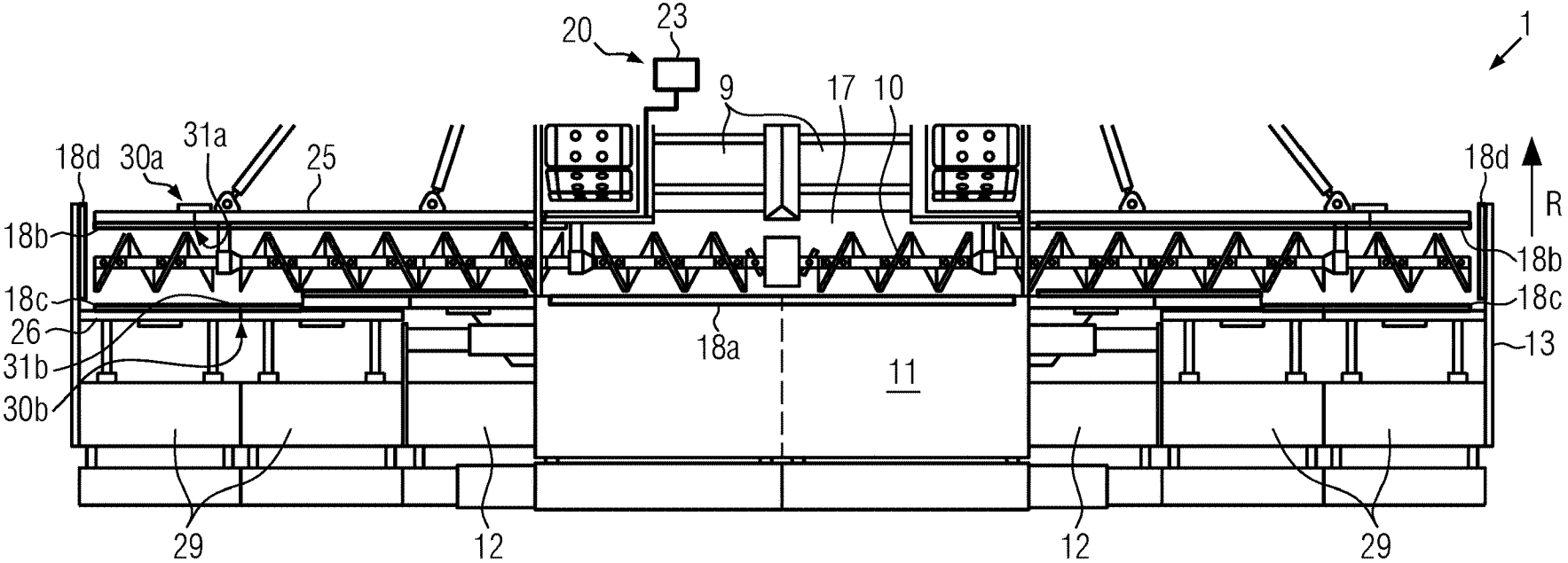
FIG. 5 shows a screed with extended pull-out parts and attachments laterally attached thereat for producing a desired working width.

FIG. 3 shows a plan view of the screed 7 of the road finishing machine 1 in a schematic representation. The paving material 6 discharged by means of the scraper belt 9 in front of the screed basic body 11 of the screed 7 is distributed along a front side 16 of the screed basic body 11 by means of the transverse distributor auger 10. A rear wall 22 of the chassis 8 of the road finishing machine 1 forms, together with the front side 16 of the screed basic body 11, a transverse distributor channel 17 for the transverse distributor auger 10. This transverse distributor channel 17 can be further expanded to the side corresponding to a broadening of the screed 7. This is shown in FIGS. 4 and 5.

FIG. 3 furthermore shows that an intake line 18*a* is formed at the front side 16 of the screed basic body 11. The intake line 18*a* includes a plurality of intake openings 19 which are configured to suck off aerosols formed during the paving operation within the transverse distributor channel 17.

The intake line 18*a* is configured in the form of a suction rail directly at the screed basic body 11 in FIG. 3. It is thus present in a particularly compact design and permits an unrestricted view of the screed operator into the transverse distributor channel 17.

The intake line 18*a* can be configured as a suction end of a suction device 20 which is installed at the chassis 8 of the road finishing machine 1. The intake line 18*a* could be, for example, connected to a fan 23 via an exhaust air guide 21. The exhaust air guide 21 could also have a different extension, it could extend, for example, over a central auger suspension 24 to the fan 23.

Finally, FIG. 3 schematically shows a spray device 37 with a nozzle 38 to misten the aerosol formation within the transverse distributor channel 17. The spray device 37 can be configured to produce water vapor.

FIG. 4 shows the screed 7 in a schematic plan view representation with extended pull-out parts 12. With such a broadening of the screed 7, a larger working width B for the newly produced paving layer 2 can be produced. FIG. 4 shows that the transverse distributor channel 17 is extended sidewards beyond the screed basic body 11. Along the broadened transverse distributor channel 17, the paving material 6 discharged by the scraper belt 9 can be transported to the outer sides of the pull-out parts 12. The transverse distributor auger 10 arranged within the transverse distributor channel 17 in FIG. 4 is also extended.

The transverse distributor channel 17 arranged in front of the screed 7 is formed at its outer regions transversely to the direction of travel R by means of channel plates 25 supported at the chassis 8 of the road finishing machine 1, and by means of pre-scrapers 26 attached laterally of the screed basic body 11. Depending on the set working width B, the channel plates 25 and the pre-scrapers 26 can be further extended to the side to extend the transverse distributor channel 17. The same analogously applies to the transverse distributor auger 10.

FIG. 4 moreover shows that the intake line 18*a* formed at the front side 16 of the screed basic body 11 is extended by further intake lines 18*b*, 18*c* to suck off aerosols from the transverse distributor channel 17. The intake lines 18*a*, 18*b*, 18*c* are thereby, according to FIG. 4, formed along the transverse distributor channel 17 at a side 27 of the channel plates 25 facing the transverse distributor auger 10, at a side 28 of the pre-scrapers 26 facing the transverse distributor auger 10, and at the front side 16 of the screed basic body 11.

As an integral part at the channel plates 25 and the pre-scrapers 26, in particular the intake lines 18*b*, 18*c* permit the screed operator a view into the transverse distributor channel 17 without any obstructions.

FIG. 5 shows the screed 7 with extended pull-out parts 12 and attachments 29 laterally fixed thereto for producing a very large working width B for the paving layer 2. FIG. 5 shows that the transverse distributor channel 17 is formed along the screed basic body 11, the pull-out parts 12, and along the attachments 29 fixed thereto transversely to the direction of travel R. Corresponding to the working width B, further channel plates 25 and pre-scrapers 26 were mounted to further extend the transverse distributor channel 17.

FIG. 5 furthermore shows that the intake lines 18*b*, 18*c* formed at the channel plates 25 and the pre-scrapers 26 are extended to be able to suck off aerosols along the complete extension of the transverse distributor channel 17. At separating points 30*a* of the channel plates 25 and at separating points 30*b* of the pre-scrapers 26, coupling ends 31 of the intake lines 18*b*, 18*c* are connected to each other.

FIGS. 3 to 5 show an intake line 18*d* which is arranged at the side pusher 13 of the external control platform 14. The intake line 18*d* can be configured as part of a suction device separately provided for the external control platform 14.

Figure 6:
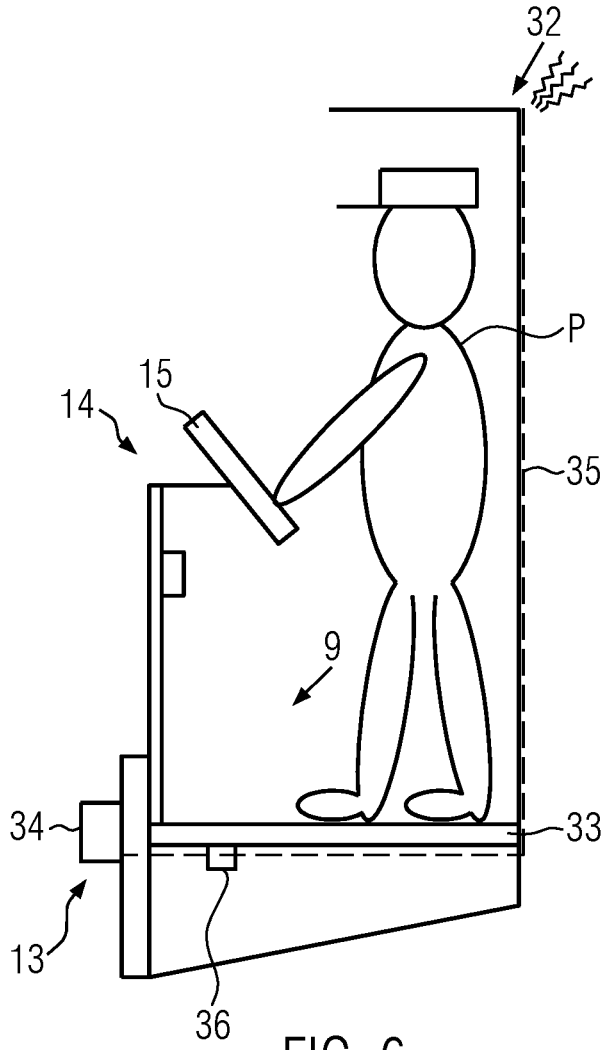
FIG. 6 shows an external control platform of a screed in a schematic representation.

FIG. 6 shows, in a schematic representation, the external control platform 14 of FIG. 2 with a roof structure 32 for a screed operator P. The external control platform 14 shows that the screed operator P is standing on a gangway 33 which extends behind the screed 7 over the paving layer 2. The gangway 33 is also shown in FIG. 1. A fan 34 is provided at the side pusher 13. The fan 34 can be connected with the intake lines 18*b*, 18*c*, 18*d* to suck off aerosols from the transverse distributor channel 17. FIG. 6 furthermore shows that an exhaust air line 35, which is schematically represented in FIG. 6 as a dashed line, ejects the sucked-off aerosols above the roof structure 32 from the fan 34. FIG. 6 furthermore shows an activated-carbon filter unit 36 for purifying the aerosols sucked off from the transverse distributor channel 17.

The intake lines 18*a*, 18*b*, 18*c*, 18*d* directly and integrally installed at the side pusher 13 of the external control platform 14, at the screed basic body 11, the channel plates 25, and/or the pre-scrapers 26 form an advantageous inlet geometry for the suction device 20 at the road finishing machine 1. In particular its compact construction reduced as to the existing structures permit the screed operator to have a perfect view into the transverse distributor channel 17 independent of how far it is extended in front of the screed 7. The integral design of the intake lines 18*a*, 18*b*, 18*c*, 18*d* overall offers reduced manufacturing and assembly efforts at the road finishing machine 1.

Figure 7:
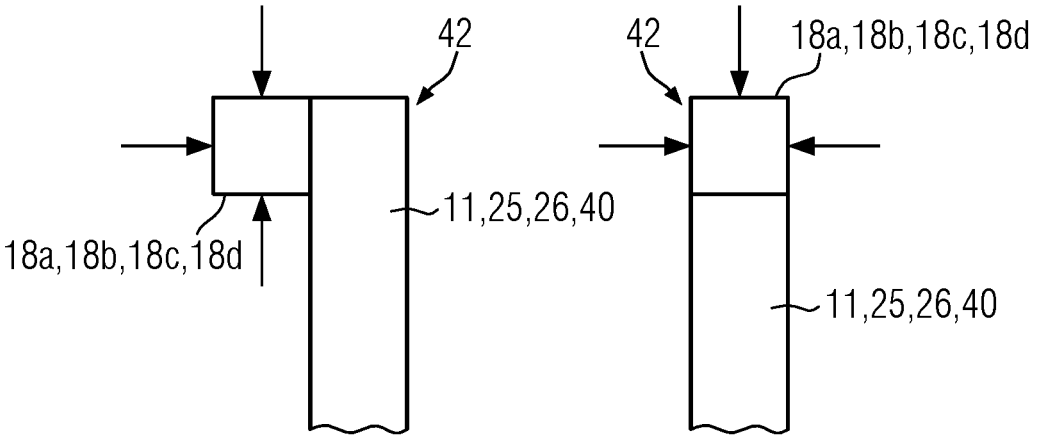
FIG. 7 shows schematically represented positioning variants of the intake line at its support component.

FIG. 7 schematically shows that the intake lines 18*a*, 18*b*, 18*c*, 18*d* can be formed, in the assembled state according to the left representation, either in the foreground, that means as a visible attachment at the respective support components (i.e., at the channel plates, the pre-scrapers, at the screed basic body 11, and/or at the side pusher support 40), or can be formed, according to the right representation of FIG. 7, to be integrated in the construction of the support components.

The intake lines 18*a*, 18*b*, 18*c*, 18*d* are arranged in FIG. 7 at a level of an upper edge 42 of the channel plates 25 and pre-scrapers 26. The intake lines 18*a*, 18*b*, 18*c*, 18*d* thus together form a frame essentially surrounding the transverse distributor channel 17 to suck off the aerosols formed in the transverse distributor channel 17. The arrows pointing in the direction of the intake lines 18*a*, 18*b*, 18*c*, 18*d* in FIG. 7 indicate at which sides the sucking-off of the aerosols is possible.

What is claimed is:

1. A road finishing machine comprising:

a screed for producing a paving layer from a paving material;

a material bunker for receiving the paving material;

a longitudinal conveying device which is configured to transport the paving material from the material bunker against a direction of travel of the road finishing machine toward the screed;

a transverse distributor auger which is configured to distribute the paving material transported toward the screed by the longitudinal conveying device transversely to the direction of travel in front of the screed, wherein the transverse distributor auger is mounted, in the direction of travel, in front of a screed basic body of the screed within a transverse distributor channel arranged for transverse distribution of the paving material in front of the screed, wherein the transverse distributor channel is formed transversely to the direction of travel in front of the screed at least in sections by channel plates supported at a chassis of the road finishing machine, and by pre-scrapers attached laterally of the screed basic body of the screed, wherein each of the pre-scrapers is arranged in front of a portion of the screed with respect to the direction of travel; and at least one suction device with at least one intake line which is configured to suck off aerosols formed during the transverse distribution of the paving material from regions along the transverse distributor channel, wherein the at least one intake line is arranged at least in sections at the channel plates and/or at least in sections at the pre-scrapers.

2. The road finishing machine according to claim 1, wherein the at least one intake line comprises a pipeline extending transversely to the direction of travel, and/or the at least one intake line comprises a rectangular pipe.

3. The road finishing machine according to claim 1, wherein the at least one intake line includes a wall which is formed, at least in sections, as an integral part of the channel plates, the pre-scrapers, a front side of a screed basic body, and/or a component of an external control platform.

4. The road finishing machine according to claim 1, wherein the at least one intake line is formed, at least in sections, along an upper edge of the channel plates, along an upper edge of the pre-scrapers, and/or along an upper edge of a side pusher support of an external control platform.

5. The road finishing machine according to claim 1, wherein the at least one intake line is dimensioned such that the transverse distributor channel is essentially uncovered, seen from above.

6. The road finishing machine according to claim 1, wherein the at least one intake line forms an exhaust air guide oriented transversely to the direction of travel along the transverse distributor channel.

7. The road finishing machine according to claim 1, wherein the at least one intake line includes a plurality of interconnectable line sections whose coupling ends are formed in a region of separating points of channel plates attached one next to the other, and/or of pre-scrapers.

8. The road finishing machine according to claim 7, wherein adjacent channel plates and/or pre-scrapers are assembled by the coupling ends of the at least one intake line.

9. The road finishing machine according to claim 1, wherein the at least one intake line includes a plurality of passages as intake openings.

10. The road finishing machine according to claim 9, wherein the at least one intake line includes at least one closing mechanism for opening and closing at least one of the intake openings, and/or the intake openings are formed at different side walls of the at least one intake line.

11. The road finishing machine according to claim 1, wherein the at least one suction device includes at least one fan connected with the at least one intake line, the at least one fan being arranged in a region of an external control platform of the screed at a side pusher formed thereat for setting a working width.

12. The road finishing machine according to claim 1, wherein the at least one suction device includes, at an outlet side, at least one exhaust air line for ejecting the aerosols sucked off from the transverse distributor channel, and wherein the at least one exhaust air line is attached to a roof structure of an external control platform of the screed.

13. The road finishing machine according to claim 1, wherein the at least one suction device includes at least one activated-carbon filter unit.

14. The road finishing machine according to claim 1, wherein the at least one intake line comprises an intake line at a channel plate of the channel plates which is positioned closest to the chassis of the road finishing machine, and the intake line is configured for coupling with a vent line provided at the chassis of the road finishing machine.

15. The road finishing machine according to claim 1, wherein the at least one suction device includes at least one spray device for spraying a fluid into the transverse distributor channel, wherein the at least one spray device comprises at least one nozzle which is attached to the at least one intake line.

16. The road finishing machine according to claim 1, wherein the at least one intake line is arranged at least in sections at a front side of the screed basic body facing the transverse distributor auger.

17. The road finishing machine according to claim 1, wherein the at least one intake line is arranged at least in sections at an external control platform of the screed.

18. A road finishing machine comprising:

a screed for producing a paving layer from a paving material;

a material bunker for receiving the paving material;

a longitudinal conveying device configured to transport the paving material from the material bunker against a direction of travel of the road finishing machine toward the screed;

a transverse distributor auger configured to distribute the paving material transported toward the screed by the longitudinal conveying device transversely to the direction of travel in front of the screed, wherein the transverse distributor auger is arranged in a transverse distributor channel in front of a screed basic body of the screed, with respect to the direction of travel;

a channel plate supported at a chassis of the road finishing machine in front of the transverse distributor auger, with respect to the direction of travel;

a pre-scraper attached laterally of the screed basic body of the screed, wherein the pre-scraper is arranged behind the transverse distributor auger and in front of a portion of the screed, with respect to the direction of travel; and at least one suction device with at least one intake line configured to suck off aerosols formed during transverse distribution of the paving material, wherein the at least one intake line is arranged, at least in a section, at the channel plate and/or at the pre-scraper;

wherein the channel plate and the pre-scraper form at least a section of the transverse distributor channel.

19. The road finishing machine according to claim 18, wherein the at least one intake line is arranged, at least in another section, at an external control platform of the screed.

20. The road finishing machine according to claim 18, wherein the at least one intake line is arranged, at least in another section, at a front side of the screed basic body facing the transverse distributor auger.

* * * * *